US007108068B2

(12) United States Patent
Stevens et al.

(10) Patent No.: US 7,108,068 B2
(45) Date of Patent: Sep. 19, 2006

(54) FLOATING PLATE BACK PRESSURE VALVE ASSEMBLY

(75) Inventors: Michael D. Stevens, Duncan, OK (US); Earl D. Webb, Wilson, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 214 days.

(21) Appl. No.: 10/867,810

(22) Filed: Jun. 15, 2004

(65) Prior Publication Data

US 2005/0274525 A1 Dec. 15, 2005

(51) Int. Cl.
*E21B 34/06* (2006.01)
*E21B 34/00* (2006.01)
*F16K 31/18* (2006.01)

(52) U.S. Cl. ..... 166/327; 166/325; 166/319; 137/433

(58) Field of Classification Search ..... 166/319, 166/320, 332.8, 325, 327; 137/433, 515
See application file for complete search history.

(56) References Cited

U.S. PATENT DOCUMENTS 3,129,764 A * 4/1964 Stein ..... 166/333.1
3,776,250 A 12/1973 Knox
3,941,516 A * 3/1976 Soberg ..... 417/259
4,613,164 A * 9/1986 Hughes et al. ..... 285/27
4,683,955 A 8/1987 Stepp et al.
4,905,775 A * 3/1990 Warren et al. ..... 175/38
5,150,756 A * 9/1992 Hassanzadeh ..... 166/318
5,472,053 A 12/1995 Sullaway et al.
5,641,021 A 6/1997 Murray et al.
5,647,434 A 7/1997 Sullaway et al.
6,224,356 B1 * 5/2001 Dewar et al. ..... 418/55.1
6,296,061 B1 * 10/2001 Leismer ..... 166/386
6,782,952 B1 * 8/2004 Garay et al. ..... 166/374

* cited by examiner

*Primary Examiner*—David Bagnell
*Assistant Examiner*—Shane Bomar
(74) *Attorney, Agent, or Firm*—John W. Wustenberg; McAfee & Taft

(57) ABSTRACT

A back pressure valve assembly for use in a well casing string. The valve assembly comprises a housing with a stationary and a floating plate therein. The floating plate is moveable between an open position spaced from the stationary plate and a closed position engaging the stationary plate. Fluid flow downwardly through the valve assembly tends to move the floating plate toward the open position, and fluid flow upwardly through the valve assembly tends to move the floating plate toward the closed position. A finger or key may be used to prevent rotation of the floating plate with respect to the housing.

32 Claims, 5 Drawing Sheets

FLOATING PLATE BACK PRESSURE VALVE ASSEMBLY

BACKGROUND

The present invention relates generally to well casing fill apparatus and methods, and more particularly, to such an apparatus having a floating plate back pressure valve therein.

In the construction of oil and gas wells, a well bore is drilled into one or more subterranean formations or zones containing oil and/or gas to be produced. In most instances, after the well bore is drilled, the drill string is removed and a string of casing is run into the well bore while maintaining sufficient drilling fluid in the well bore to prevent blowouts. The term "casing string" is used herein to mean any string of pipe which is lowered into and cemented in a well bore including, but not limited to, surface casing, liners and the like.

During casing running operations, the casing string must be kept filled with fluid to prevent excessive fluid pressure differentials across the casing string and to prevent blowouts. In the past, fluid was added to the casing string at the surface after each additional casing joint was connected to the string and lowered into the well bore. Alternatively, casing fill apparatus have been utilized at or near the bottom end of the casing string to allow well fluids to enter the interior of the casing string as it is run down the well bore.

While these casing fill apparatus have been used successfully, they are relatively complex and have certain limitations. Generally, most of the prior devices include a spring-loaded, poppet-style back pressure valve which is used after the casing is positioned in the well bore to allow fluid to be pumped downwardly through the casing string while preventing reverse flow. In order to fill the casing string as it is run into the well bore, the back pressure valve must be held in an open position until the string reaches the desired location in the well bore. Typically, a shearable member holds the valve open and then is sheared when it is desired to use the valve. Not only does this arrangement require a number of precise parts, but the shearing of the shearable member requires an additional step in the process. The cost of these prior casing fill apparatus is not insignificant.

There is a need, therefore, for a casing fill apparatus that is more simple in construction and which allows filling of the casing string while running it in but does not require the step of shearing a shearable member to allow the device to operate as a back pressure valve once in the desired operating position. The present invention solves these problems by providing a simple moving or floating plate which cooperates with a stationary plate to allow flow in one direction but prevent undesired reverse flow. It also still allows the casing string to fill while running it into the well bore.

SUMMARY

The present invention is a floating back pressure valve assembly for use in a casing string positionable in a well bore which uses a plate which moves or floats with respect to a stationary plate.

The invention may be described as a valve apparatus for use in a casing string comprising a housing adapted for connection to the casing string and in communication therewith, a stationary plate disposed in the housing and defining a stationary plate port therethrough, and a floating plate disposed in the housing and defining a floating plate port therethrough which is unaligned with the stationary plate port. The floating plate is moveable between an open position spaced from the stationary plate and a closed position substantially sealingly engaging the stationary plate. The housing comprises an upper housing portion and a lower housing portion, and the stationary plate is disposed between the upper and lower housing portions.

In an exemplary embodiment, the stationary plate is an upper plate, and the floating plate is a lower plate below the upper plate. The floating plate port is a central port, and the stationary plate port is one of a plurality of angularly spaced stationary plate ports. The stationary plate ports are disposed radially outwardly from the floating plate port.

The apparatus may further comprise a seal for sealing between the stationary plate and the housing. Preferably, the seal is molded on the stationary plate. This seal may comprise a tab extending therefrom toward the floating plate, wherein the tab keeps the floating plate spaced from the stationary plate until sufficient pressure is applied to the floating plate to deform the tab. Thus, the floating plate will be held away from the stationary plate as the valve assembly is lowered into a well bore as part of a casing string so that the casing string may fill as it is lowered. However, the floating plate will deform the tabs on the seal and engage the stationary plate if well and cementing fluids start to flow upwardly through the valve assembly.

The apparatus may further comprise another seal for sealing between the floating plate and the housing. Preferably this seal is molded on the floating plate.

The floating plate may be prevented from rotating with respect to the housing. In one embodiment, the housing defines a slot therein, and the floating plate has a finger extending therefrom into the slot such that the floating plate may move longitudinally in the housing while being prevented from rotating therein. In another embodiment, the housing defines a housing slot therein, the floating plate defines a plate slot therein aligned with the housing slot, and the apparatus further comprises a key disposed in the housing slot and plate slot such that the floating plate may move longitudinally in the housing while being prevented from rotating therein.

The stationary plate and floating plate are preferably made of a drillable material. The housing can be made of a drillable material or a non-drillable material. The valve assembly of the present invention may be made as part of the casing string or as part of an assembly that is secured in a larger housing, such as current float equipment.

Numerous objects and advantages of the present invention will become apparent by those skilled in the art when the following detailed description of the invention is read in conjunction with the drawings illustrating such embodiments.

BRIEF DESCRIPTION OF THE DRAWINGS

FIG. 6 is a longitudinal cross-sectional view of a third embodiment of the apparatus.

FIG. 8 is a longitudinal cross-sectional view of a fourth embodiment of the apparatus.

DETAILED DESCRIPTION

Figure 1:
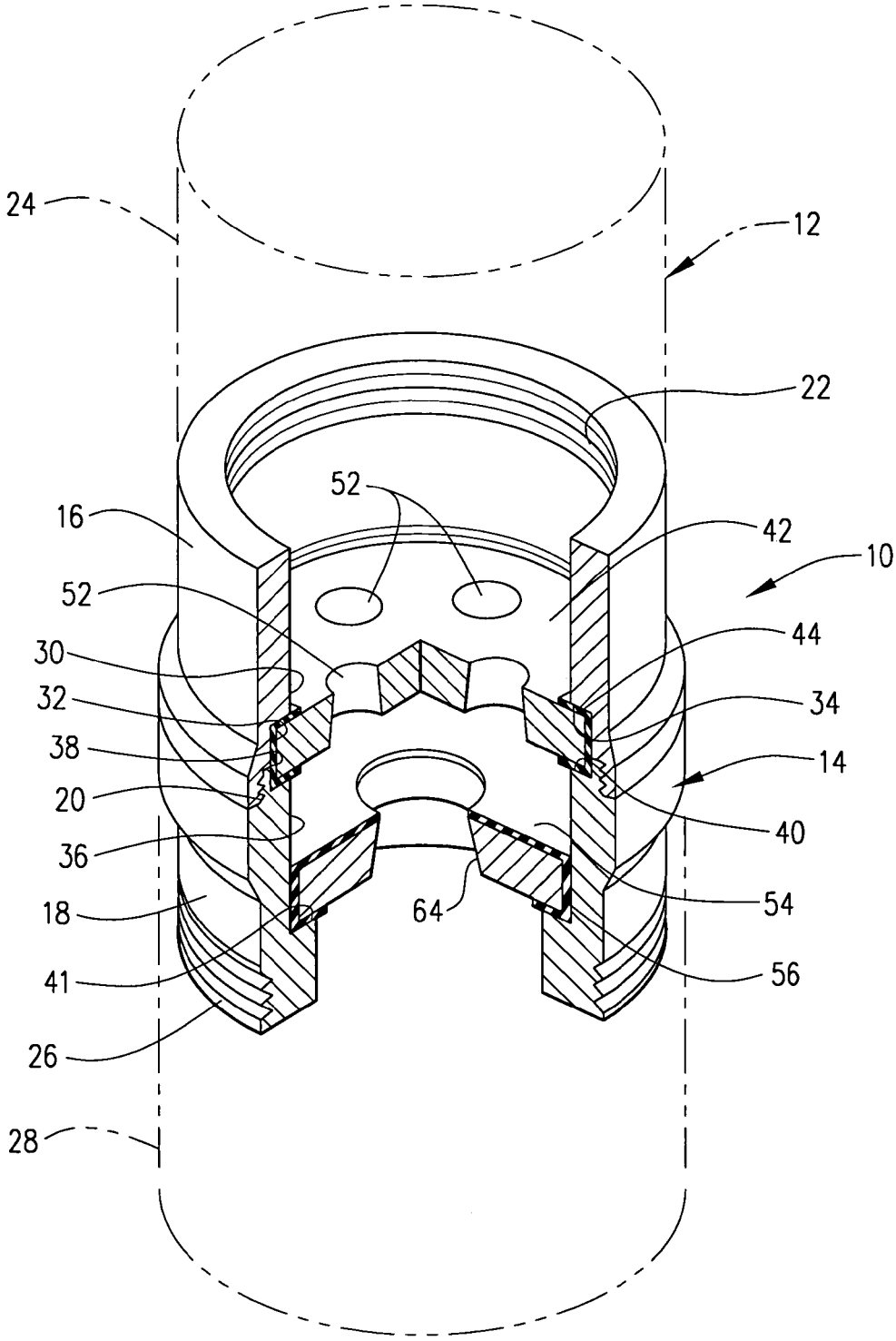
FIG. 1 is a cutaway perspective view of the floating plate back pressure valve assembly of the present invention.
Figure 2:
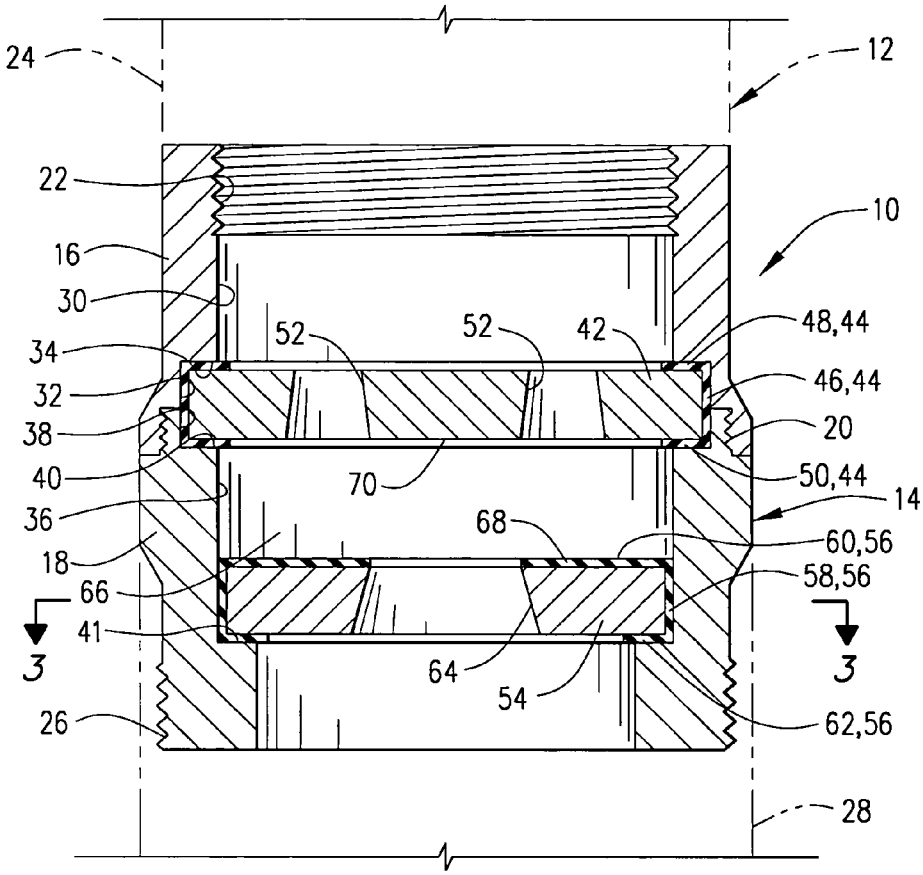
FIG. 2 is a longitudinal cross-sectional view of a first embodiment of the apparatus.
Figure 3:
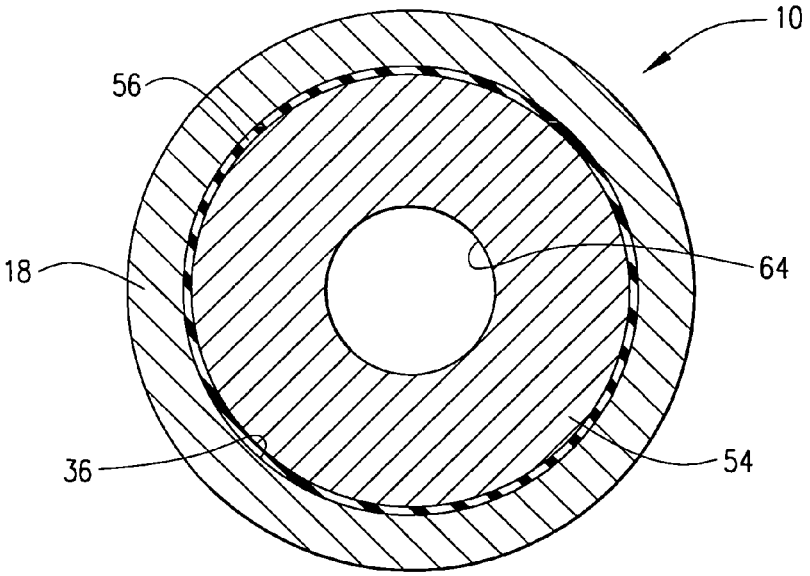
FIG. 3 is a cross section taken along lines 3—3 in FIG. 2.

Referring now to the drawings, and more particularly to FIGS. 1 and 2, the floating plate back pressure valve assembly of the present invention is shown and generally designated by the numeral 10. Valve assembly 10 is intended for use in a casing string 12.

Valve assembly 10 comprises a housing 14. Housing 14 includes an upper housing portion 16 attached to a lower housing portion 18 by a threaded connection 20. Upper housing portion 16 has an internally threaded surface 22 adapted for connection to an upper casing string portion 24. Lower housing portion 18 may be the lowermost component in casing string 12, but there may be occasions when it may instead be an intermediate component of the casing string. For the latter configuration, lower housing portion 18 has an externally threaded surface 26 adapted for connection to a lower casing string portion 28.

Upper housing portion 16 has a first bore 30 and a larger second bore 32 therein. A downwardly facing shoulder 34 extends between first and second bores 30 and 32.

Lower housing portion 18 has a first bore 36 and a larger second bore 38 therein. An upwardly facing shoulder 40 extends between first and second bores 36 and 38. Below first bore 36, lower housing portion 18 has another upwardly facing shoulder 41.

First bore 30 in upper housing portion 16 is substantially the same diameter as first bore 36 in lower housing portion 18. Second bore 32 in upper housing portion 16 is substantially the same diameter as second bore 38 in lower portion 18.

A stationary upper plate 42 is disposed in first bores 30 and 36 of upper and lower housing portions 16 and 18, respectively, between shoulders 34 and 40. A seal 44 is disposed around upper plate 42. As best seen in FIG. 2, seal 44 has an outer circumferential portion 46 and inwardly extending upper lip 48 and lower lip 50. Seal 44 is preferably made of an elastomeric material molded on upper plate 42. It will be seen by those skilled in the art that the seal provides sealing engagement between upper plate 42 and upper and lower housing portions 16 and 18.

Upper plate 42 defines a plurality of angularly spaced stationary or upper plate ports 52 therethrough. Ports 52 are preferably tapered. The taper serves two purposes. First, it allows easy removal of upper plate 42 from the tooling when the part is molded. Second, the taper creates a pressure differential across the top of ports 52 when the fluid enters as opposed to when the fluid exits the bottom of upper plate 42.

A moving or floating lower plate 54 is moveably disposed in first bore 36 of lower housing portion 18 below upper plate 42. A seal 56 is disposed around lower plate 54. As best seen in FIG. 2, seal 56 has an outer circumferential portion 58 and inwardly extending upper lip 60 and lower lip 62. Upper lip 60 covers the top of lower plate 54. Seal 56 is preferably made of an elastomeric material molded on lower plate 54. It will be seen by those skilled in the art that the seal provides sealing engagement between lower plate 54 and lower housing portion 18.

Lower plate 54 defines a central or lower plate port 64 therethrough. Port 64 is tapered for the same reasons as ports 52 in upper plate 42. Port 64 in lower plate 54 is sized such that it does not overlap ports 52 in upper plate 42. That is, ports 52 are spaced radially outwardly from port 64.

In operation, valve assembly 10 is connected into casing string 12 as previously described. When running into the well bore, lower plate 54 is in its lowermost, open position adjacent to shoulder 41 in lower housing portion 18 such that a space 66 is formed between upper plate 42 and lower plate 54. Those skilled in the art will see that a flow path is thus provided through valve assembly 10 by port 64 in lower plate 54, space 66 and ports 52 in upper plate 42. In this way, casing string 12 fills as it is run into the well bore, preventing pressure from building up below it which would make running it in more difficult. If the rate of fill through valve assembly 10 is not too great, lower plate 54 will not move upwardly as casing string 12 is run. If there is a possibility that the fill rate will cause enough flow through port 64 to move lower plate 54 upwardly, fourth embodiment 300 of the invention, described subsequently herein, may be used.

When casing string 12 is positioned at the desired depth in the well bore, a cementing operation is preferably carried out. During this process, a cement slurry is pumped down casing string 12, through ports 52, space 66 and port 64 in valve assembly 10 and out the bottom of the casing string 12 into the well annulus defined between casing string 12 and the well bore. It will be seen by those skilled in the art that pumping fluid down casing string 12 will tend to keep lower plate 54 in its lowermost, open position. However, if the heavy cement slurry reverses the flow, the flow rate of slurry through port 64 in lower plate 54 will move lower plate 54 upwardly toward upper plate 42. When lower plate 54 reaches upper plate 42, upper side 68 of upper lip 60 of seal 56 substantially sealingly engages lower side 70 of upper plate 42. Because port 64 in lower plate 54 is unaligned with, and does not overlap, ports 52 in upper plate 42, upward fluid flow through valve assembly 10 is prevented. That is, valve assembly 10 acts as a back check valve allowing fluid flow only downwardly therethrough while cementing.

Upper plate 42 and lower plate 54 of valve assembly 10 may be made of drillable materials, such as aluminum or composite plastics. Housing 14 may be made of a drillable material or a non-drillable material as desired. However, the invention is not intended to be limited to any particular material of construction.

Second Embodiment

Figure 4:
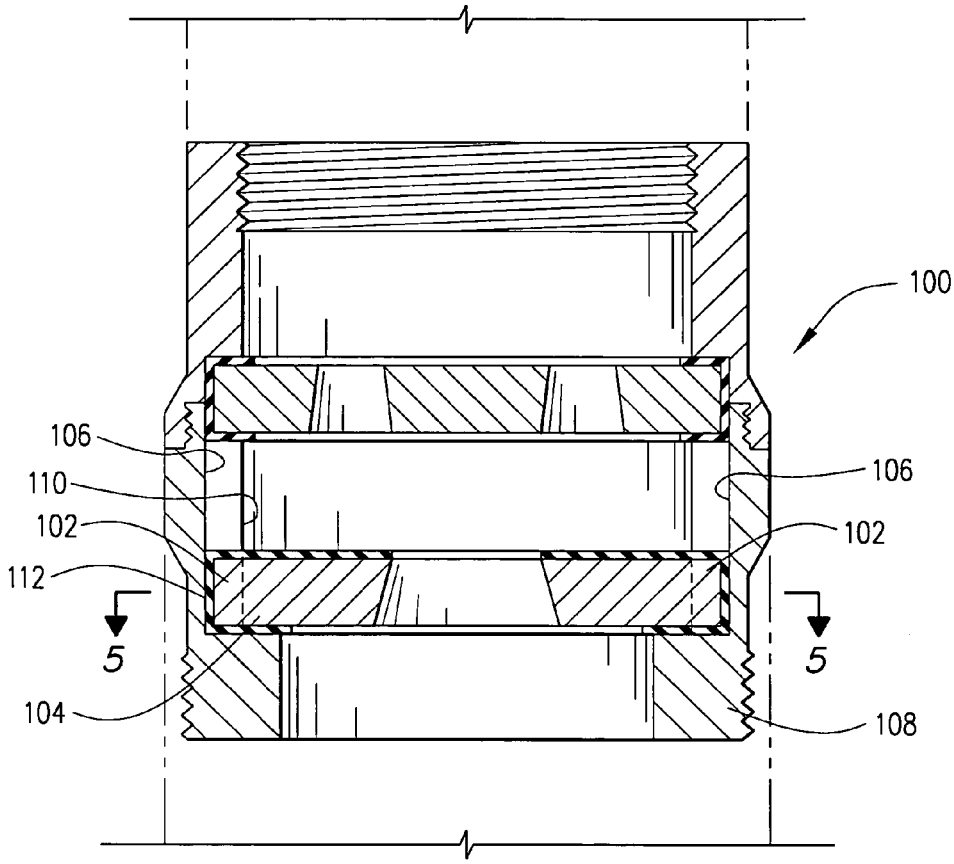
FIG. 4 is a longitudinal cross-sectional view of a second embodiment of the apparatus.
Figure 5:
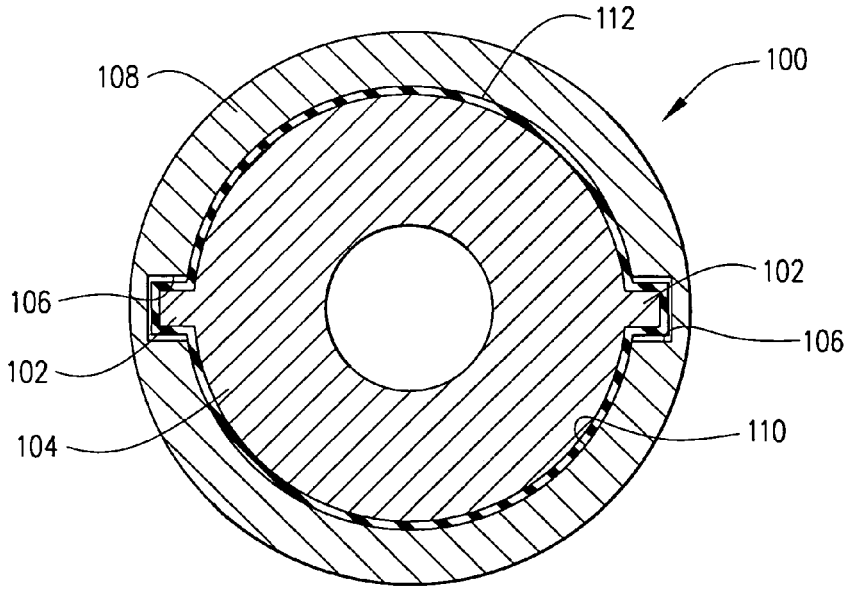
FIG. 5 is a cross section taken along lines 5—5 in FIG. 4.
Figure 5:
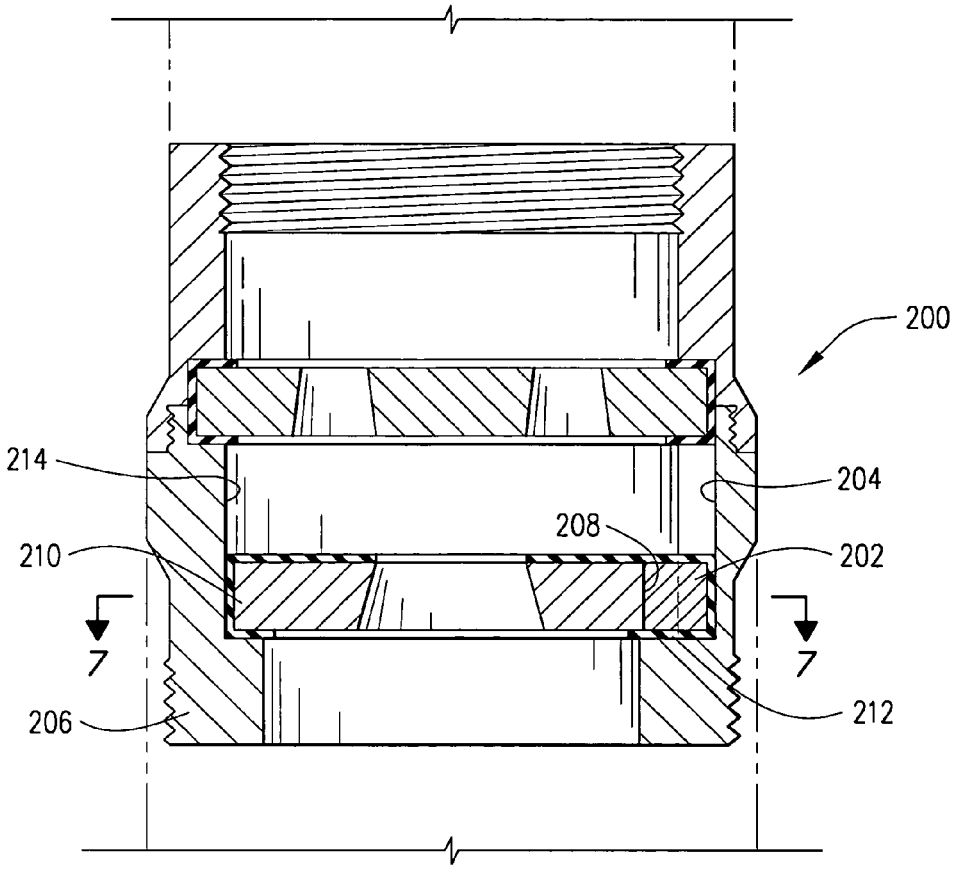

Referring now to FIGS. 4 and 5, a second embodiment of the floating plate back valve assembly of the present invention is shown and generally designated by the numeral 100. The components of second embodiment valve assembly 100 are substantially the same as first embodiment valve assembly 10, except that the second embodiment has one or more anti-rotation fingers 102 extending from a lower plate 104. Two fingers 102 are shown in the drawings, but the invention is not intended to be limited to any particular number. Each finger 102 extends into a longitudinally extending housing slot 106 defined in lower housing portion 108.

Second embodiment valve assembly 100 is operated in a manner substantially the same as first embodiment valve assembly 10. When lower plate 104 moves in first bore 110 of lower housing portion 108, fingers 102 move in housing slots 106. A seal 112 is molded around lower plate 104 including fingers 102 thereon.

Preferably, slots 106 are sized sufficiently larger than fingers 102 so that solid materials in the fluid can pass therethrough without causing lower plate 104 to be jammed or packed off.

When it is desired to drill out valve assembly 100, fingers 102 prevent rotation of lower plate 104 to facilitate the drilling.

Third Embodiment

Figure 7:
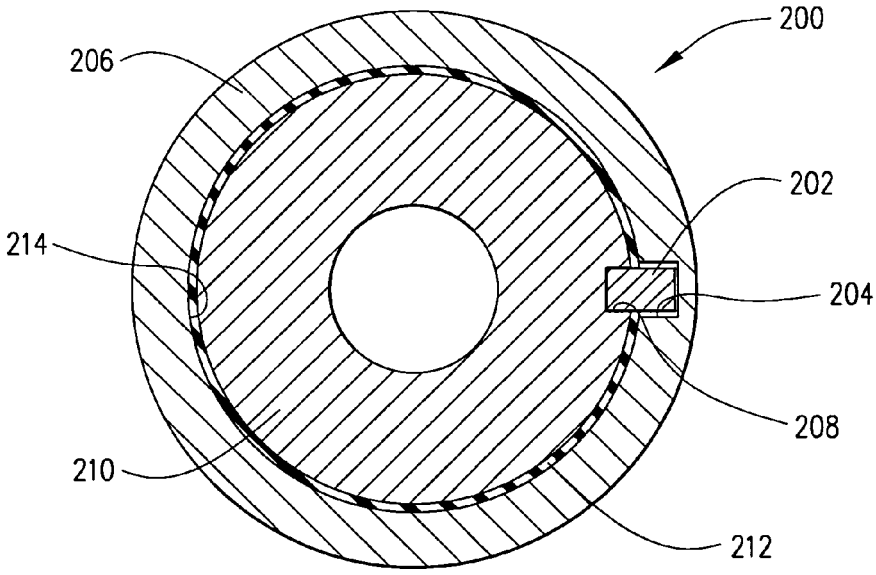
FIG. 7 is a cross section taken along lines 7—7 in FIG. 6.
Figure 5:
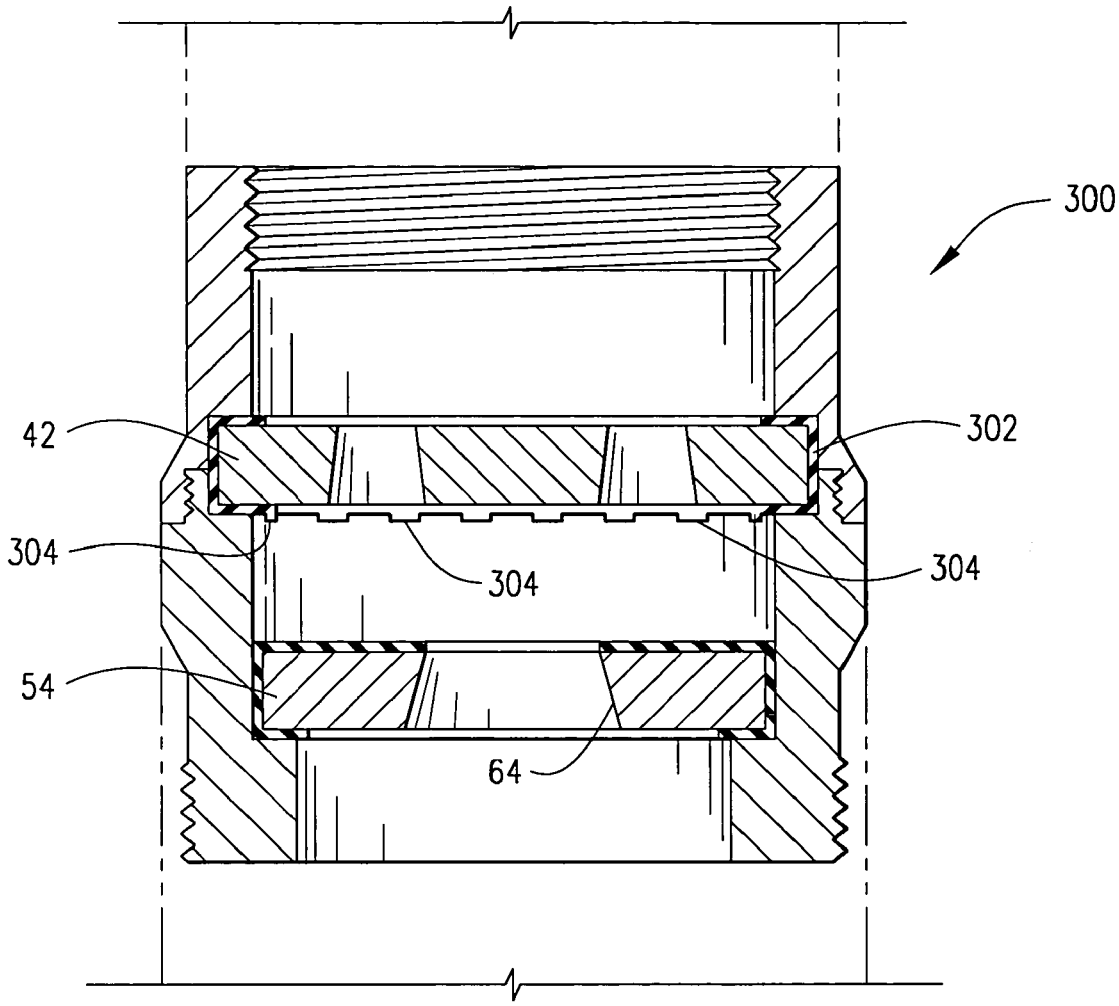

Referring now to FIGS. 6 and 7, a third embodiment of the floating plate back valve assembly of the present invention is shown and generally designated by the numeral 200. In third embodiment valve assembly 200, an anti-rotation key 202 fits in a longitudinally extending housing slot 204 defined in lower housing portion 206. Key 202 also fits in a plate slot 208 defined in lower plate 210. Key 202 is held in plate slot 208 by seal 212. While only one key 202 and plate slot 208 are shown, multiple keys and slots could be employed. The invention is not intended to be limited to any particular number.

Third embodiment valve assembly 200 is operated in a manner substantially the same as the other embodiments. When lower plate 210 moves in first bore 214 of lower housing portion 206, key 202 moves in housing slot 204.

When it is desired to drill out valve assembly 200, key 202 prevents rotation of lower plate 210 to facilitate the drilling.

Fourth Embodiment

Referring to FIG. 8, a fourth embodiment of the floating plate back valve assembly of the present invention is shown and generally designated by the numeral 300. Fourth embodiment valve assembly 300 is substantially identical to first embodiment valve assembly 10 except that the fourth embodiment uses a different seal 302 molded around upper plate 42. Seal 302 has a plurality of angularly spaced and downwardly extending tabs 304 thereon.

When valve assembly 300 is run into the well bore as part of a casing string, the rate of fluid flowing through port 64 in lower plate 54 may be sufficient to move the lower plate upwardly towards its closed position adjacent to upper plate 42. This is undesirable because it hinders running in the casing string as previously described. Tabs 304 on fourth embodiment seal 302 will keep lower plate 54 from sealing against upper plate 42 so that fluid flow is still allowed upwardly therethrough. During the subsequent cementing operation, the pressure of any cement slurry which tends to flow back through fourth embodiment valve assembly 300 is considerably higher than the pressures encountered in running the casing into the well bore. Thus, any back flow during or after cementing will force lower plate 54 to deform tabs 304 and press them sufficiently flat so that the lower plate will engage upper plate 42, preventing upward flow of the cement slurry.

It will be seen that fourth embodiment valve assembly 300 could incorporate the anti-rotation finger 102 of second embodiment valve assembly 100 or the anti-rotation key 202 of third embodiment valve assembly 200.

It will be seen, therefore, that the floating plate back pressure valve of the present invention is well adapted to carry out the ends and advantages mentioned, as well as those inherent therein. While several embodiments of the invention have been described for the purposes of this disclosure, numerous changes in the arrangement and construction of parts may be made by those skilled in the art. All such changes are encompassed within the scope and spirit of the appended claims.

What is claimed is:

1. A valve apparatus for use in a casing string, comprising:
a housing adapted for connection to the casing string and in communication therewith;
a stationary plate disposed in the housing and defining a stationary plate port therethrough; and
a floating plate disposed in the housing and defining a floating plate port therethrough which is unaligned with the stationary plate port, wherein the floating plate is moveable within the housing upon the application of fluid pressure from an open position spaced from the stationary plate to a closed position engaging the stationary plate.

2. The apparatus of claim 1 wherein:
the stationary plate is an upper plate; and
the floating plate is a lower plate below the upper plate.

3. The apparatus of claim 1, wherein:
the floating plate port is a central port; and
the stationary plate port is one of a plurality of angularly spaced stationary plate ports.

4. The apparatus of claim 3 wherein the stationary plate ports are disposed radially outwardly from the floating plate port.

5. The apparatus of claim 1 further comprising a seal for sealing between the stationary plate and the housing.

6. The apparatus of claim 5 wherein the seal is molded on the stationary plate.

7. The apparatus of claim 6 wherein:
the seal comprises a tab extending therefrom toward the floating plate; and
the tab keeps the floating plate spaced from the stationary plate until sufficient pressure is applied to the floating plate to deform the tab.

8. The apparatus of claim 1 further comprising a seal for sealing between the floating plate and the housing.

9. The apparatus of claim 8 wherein the seal is molded on the floating plate.

10. The apparatus of claim 1 wherein the floating plate is prevented from rotating with respect to the housing.

11. The apparatus of claim 10 wherein:
the housing defines a slot therein; and
the floating plate has a finger extending therefrom into the slot such that the floating plate may move longitudinally in the housing while being prevented from rotating therein.

12. The apparatus of claim 11 wherein:
the slot is one of a plurality of slots;
the finger is one of a plurality of fingers; and
each finger extends into a corresponding slot.

13. The apparatus of claim 10 wherein:
the housing defines a housing slot therein;
the floating plate defines a plate slot therein aligned with the housing slot; and
the apparatus further comprises a key disposed in the housing slot and the plate slot such that the floating plate may move longitudinally in the housing while being prevented from rotating therein.

14. The apparatus of claim 13, wherein:
the housing slot is one of a plurality of housing slots;
the plate slot is one of a plurality of plate slots aligned with corresponding housing slots;
the key is one of a plurality of keys; and
each key is disposed in corresponding housing and plate slots.

15. The apparatus of claim 1 wherein the stationary and floating plates are made of a drillable material.

16. The apparatus of claim 1 wherein:

the housing comprises an upper housing portion and a lower housing portion; and the stationary plate is disposed between the upper and lower housing portions.

17. A valve apparatus for using in a casing string, comprising:

a housing comprising:

an upper housing portion adapted for connection to the casing string, wherein the upper housing portion has a first bore and a larger second bore therein such that a shoulder is defined between the first and second bores in the upper housing portion; and a lower housing portion connected to the upper housing portion, wherein the lower housing portion has a first bore and a larger second bore such that a shoulder is defined between the first and second bores in the lower housing portion;

an upper plate disposed in the second bores and between the shoulders of the upper and lower housing portions, wherein the upper plate defines an upper plate port therein; and a lower plate disposed in the first bore of the lower housing portion and moveable between an open position longitudinally spaced from the upper plate and a closed position engaging the upper plate, wherein the lower plate defines a lower plate port therein radially spaced from the upper plate port.

18. The apparatus of claim 17 wherein:

the lower plate port is a central port; and the upper plate port is one of a plurality of angularly spaced upper plate ports.

19. The apparatus of claim 17 further comprising a seal for sealing between the upper plate and the upper and lower housing portions.

20. The apparatus of claim 19 wherein the seal is molded around a portion of the upper plate.

21. The apparatus of claim 20 wherein:

the seal comprises a tab extending therefrom toward the lower plate; and the tab keeps the lower plate spaced from the stationary plate until sufficient pressure is applied to the floating plate to deform the tab.

22. The apparatus of claim 17 further comprising a seal for sealing between the lower plate and the lower housing portion.

23. The apparatus of claim 22 wherein the seal is molded around a portion of the lower plate.

24. The apparatus of claim 17 wherein the lower housing portion is adapted for connection to a lower casing string portion.

25. The apparatus of claim 17 wherein the lower plate cannot rotate with respect to the housing.

26. the apparatus of claim 25 wherein:

the lower housing portion defines a slot therein; and the lower plate has a finger extending therefrom into the slot such that the lower plate may move longitudinally in the lower housing portion while being prevented from rotating therein.

27. The apparatus of claim 26 wherein:

the slot is one of a plurality of slots;

the finger is one of a plurality of fingers; and each finger extends into a corresponding slot.

28. The apparatus of claim 25 wherein:

the lower housing portion defines a housing slot therein;

the lower plate defines a plate slot therein aligned with the housing slot; and the apparatus further comprises a key disposed in the housing slot and plate slot such that the lower plate may move longitudinally in the lower housing portion while being prevented from rotating therein.

29. The apparatus of claim 28 wherein:

the housing slot is one of a plurality of housing slots;

the plate slot is one of a plurality of plate slots aligned with corresponding housing slots;

the key is one of a plurality of keys; and each key is disposed in corresponding housing and plate slots.

30. The apparatus of claim 17 wherein the upper and lower plates are made of a drillable material.

31. A valve apparatus for use in a casing string, comprising:

a housing adapted for connection to the casing string and in communication therewith;

a stationary plate disposed in the housing and defining a stationary plate port therethrough, the stationary plate port being one of a plurality of angularly spaced stationary plate ports; and a floating plate disposed in the housing and defining a central floating plate port therethrough which is unaligned with the stationary plate port, wherein the floating plate is moveable between an open position spaced from the stationary plate and a closed position engaging the stationary plate.

32. The apparatus of claim 31 wherein the stationary plate ports are disposed radially outwardly from the floating plate port.

* * * * *